US008179275B2

(12) United States Patent
Jankovsky

(10) Patent No.: US 8,179,275 B2
(45) Date of Patent: May 15, 2012

(54) SPRING FAILURE DETECTION SYSTEM AND METHOD

(75) Inventor: Thomas Jason Jankovsky, Elgin, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 372 days.

(21) Appl. No.: 12/179,316

(22) Filed: Jul. 24, 2008

(65) Prior Publication Data

US 2010/0019916 A1 Jan. 28, 2010

(51) Int. Cl.

| | |
|---|---|
| ***G08B 21/00*** | (2006.01) |
| ***E05D 15/38*** | (2006.01) |
| ***E05F 11/00*** | (2006.01) |
| ***E05F 15/00*** | (2006.01) |

(52) U.S. Cl. ..... 340/679; 340/665; 340/668; 49/197; 49/199; 49/200

(58) Field of Classification Search ..... 340/679
See application file for complete search history.

(56) References Cited

U.S. PATENT DOCUMENTS

| | | | | |
|---|---|---|---|---|
| 4,175,431 | A * | 11/1979 | DeTournay | 73/161 |
| 5,193,506 | A * | 3/1993 | Ironside et al. | 123/399 |
| 6,667,591 | B2 * | 12/2003 | Mullet et al. | 318/445 |
| 7,017,312 | B1 | 3/2006 | Mueller | |
| 7,260,917 | B2 * | 8/2007 | Brookbank et al. | 49/506 |
| 7,263,802 | B2 * | 9/2007 | Fitzgibbon et al. | 49/31 |
| 7,689,293 | B2 * | 3/2010 | Weik et al. | 700/17 |

* cited by examiner

*Primary Examiner* — Jennifer Mehmood
*Assistant Examiner* — John Mortell
(74) *Attorney, Agent, or Firm* — Fitch, Even, Tabin & Flannery, LLP

(57) ABSTRACT

A movable barrier that is at least partially counterbalanced by a spring is moved from a first position to a second position while substantially simultaneously monitoring at least one characteristic associated with moving the movable barrier to provide at least one monitored characteristic. The at least one monitored characteristic is compared to a predetermined criterion. When the at least one monitored characteristic does not meet the predetermined criterion, an alarm condition is set to indicate a failure of the spring.

35 Claims, 2 Drawing Sheets

SPRING FAILURE DETECTION SYSTEM AND METHOD

FIELD OF THE INVENTION

The field of the invention relates to movable barrier operators systems and, more specifically, to movable barrier operator systems utilizing springs.

BACKGROUND

Different types of moveable barrier operators have been sold over the years and these barrier operator systems have been used to actuate various types of moveable barriers. For example, garage door operators have been used to move garage doors and gate operators have been used to open and close gates.

Such barrier movement operators may include various mechanisms to facilitate this opening and closing of the barrier. For instance, a wall control unit may be coupled to the barrier movement operator and send signals to a head unit thereby causing the head unit to open and close the barrier. In addition, operators often include a receiver unit at the head unit to receive wireless transmissions from a hand-held code transmitter or from a keypad transmitter that may be affixed to the outside of the area barred by the barrier or other structure.

In movable barrier operator systems, the weight or tension created by the barrier is typically counterbalanced by using a spring. For example, garage door systems typically use a spring to counterbalance the weight of the door. Doors weigh a significant amount (e.g., garage doors weigh in the range of between 50 and 200 pounds for standard doors), the spring can break, for instance when the door is in the fully open position. Potential problems and/or dangers for the user can also occur when the spring is broken. If the user releases the trolley when the barrier is in the fully open position, there is the potential for the barrier to slam into the floor, possibly damaging the barrier or creating a potentially dangerous situation when the user tries to stop the door from slamming into the floor.

Previous systems have attempted to detect the aging of the springs and warn the homeowner or other user to service the spring before the spring fails. Other previous systems focused on monitoring characteristics of the spring to warn the homeowner of the impending failure of the spring. Unfortunately, both of these previous systems allow the user or homeowner to ignore the warnings and thereby allow the spring to fail. Consequently, the homeowner or other users were subject to the inconvenience presented when the spring failed. Additionally, severe damage to or the destruction of the barrier may be caused due to unheeded warnings regarding impending potential spring failure.

SUMMARY

Approaches are provided that automatically determine whether a spring has failed and prevent a barrier operator from moving the barrier when such a spring-failure situation is determined. The approaches described herein are easy to use and prevent the failure of a spring from presenting the kinds of issues that are ordinarily associated with such an event.

In many of these embodiments, a movable barrier that is at least partially counterbalanced by a spring is moved from a first position to a second position. During the movement, one or more characteristics associated with moving the movable barrier are monitored to provide at least one monitored characteristic. The one or more monitored characteristics are compared to a predetermined criterion. When the monitored characteristics do not meet the predetermined criterion, an alarm condition is set to indicate the failure of the spring.

The barrier can be moved between different positions. For example, the barrier may be moved from an open position to a closed position or from a closed position to an open position. Movement can also occur between intermediate positions or between the closed and open positions and intermediate positions.

The positions that are selected can also be spaced apart according to various dimensions. In one example, the second position is selected so as to be less than approximately two feet from the first position. The positions may be spaced apart by other dimensions as well.

Various types of predetermined criteria may also be used to determine spring failure. In one example, the predetermined criterion relate to a predetermined position along the path of the barrier and this criterion is met when the movable barrier achieves this predetermined position. In other examples, the predetermined criterion may be the barrier reaching a predetermined speed or acceleration. Other examples of predetermined criteria are possible.

Further, various actions can be taken when the alarm condition is set. For instance, movement of the movable barrier may be substantially immediately halted upon setting of the alarm condition. In other examples, movement of the movable barrier may be halted after expiration of a predetermined time period upon setting the alarm condition.

In still other examples, an annunciator may be activated upon setting the alarm condition. For instance, an audible alarm may be sounded. In other examples, a visual indicator (e.g., flashing light) may be activated. Other examples of annunciators may also be used.

Thus, approaches are provided that automatically determine whether a spring has failed and prevent the barrier operator from moving the barrier when such a situation occurs. The approaches described herein are easy to use and prevent the failure of a spring from presenting an end user with undue inconvenience or worse.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DESCRIPTION

Figure 1:
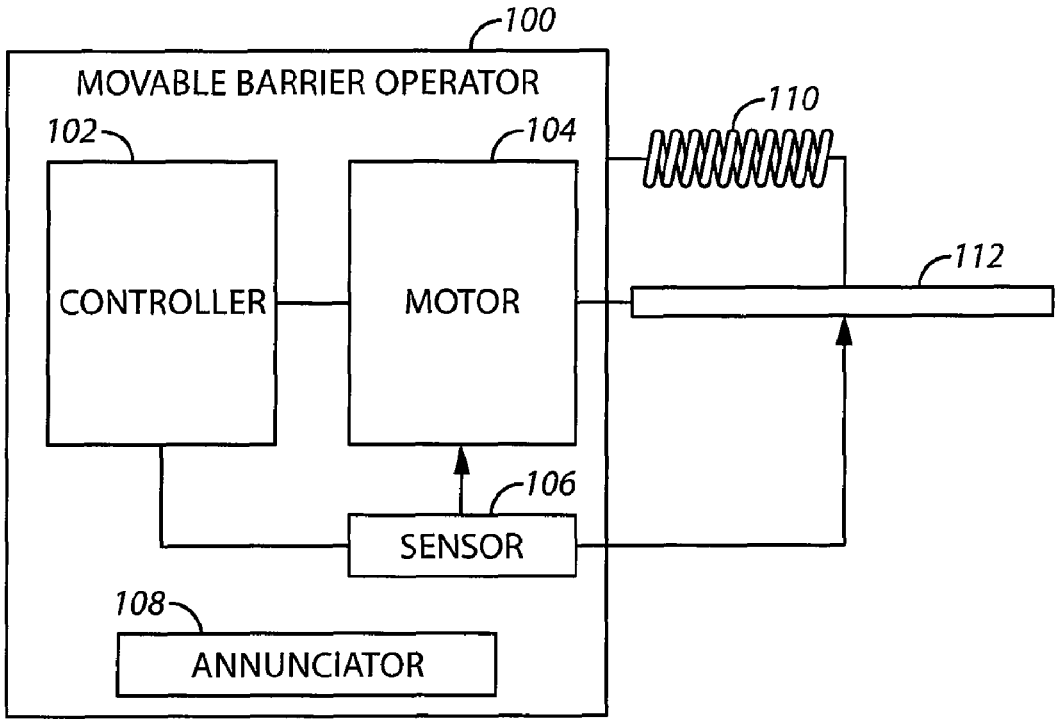
FIG. 1 comprises a block diagram of a spring failure detection system according to various embodiments the present invention.

Referring now to FIG. 1, one example of an approach that detects spring failure in a movable barrier operator system is described. A movable barrier operator 100 includes a motor 104, a controller 102, a sensor 106, and an annunciator 108. The motor 104 is coupled to a movable barrier 112 and the weight or other forces associated with the movable barrier 112 are counterbalanced at least in part using a spring 110. The sensor 106 may sense characteristics of the movement of the barrier 112 and the motor 104 and communicate these characteristics to the controller 102.

The spring 110 is any type of spring or similar device that can be used to counterbalance the weight or other associated forces associated with a barrier. The spring 110 is appropriately secured to the barrier 112 as well as an appropriate structure such as to a roof, wall, or the support structure for the barrier itself. Various springs are known in the art that are used in such an application setting. In some cases, the spring operates by extending longitudinally in order to provide the desired counterbalance force. In other cases, the spring becomes torsionally wound about its axis in order to provide this force.

The motor 104 is any type of motor that can be used to move the movable barrier 112. The sensor 106 is any type of sensor that may be used to detect characteristics associated with moving a barrier. For example, the sensor 106 may determine barrier, speed, position, and acceleration of the barrier 112. In this regard, the sensor 106 may be positioned in any appropriate location needed to measure the desired characteristic. Additionally, more than one sensor may be used.

The barrier 102 may be any type of movable barrier. For example, the barrier 112 may be a garage door, a swinging gate, a swinging door, or rolling shutters. The moveable barrier operator 100 may be any type of operator used to move any type of movable barrier. For example, the movable barrier operator 100 may be a garage door operator or a gate operator. Other examples of movable barriers and barrier operators are possible.

The controller 102 is any type of programmable device capable of executing instructions and is coupled to the motor 104 and the sensor 106. The controller 102 is arranged and configured to actuate the motor 104 to move the movable barrier 112 from a first position to a second position while substantially simultaneously monitoring at least one characteristic sensed by the sensor 106 and associated with moving the movable barrier 112. The controller 102 is further configured and arranged to compare the monitored result to a predetermined criterion, and when the monitored result does not meet the predetermined criterion, setting an alarm condition to indicate a failure of the spring 110.

In one example, the controller 102 is configured and arranged to actuate the motor to move the movable barrier 112 from a closed position to a second position. The positions from which the barrier is moved from or to which the barrier is moved to may be opened, closed, or intermediate positions along the barrier's pathway of movement. These positions may also be spaced according to a variety of dimensions relative to each other. In one example, the second position is less than approximately two feet from the first position. Other examples of dimensions for position spacing may also be used.

Various types of criterion may be used in the comparison to determine if spring failure exists. In one approach, the criterion relates to the movable barrier achieving a predetermined position and the movable barrier achieving a predetermined speed upon reaching the second position. In other examples, the criterion relates to the speed or acceleration of the barrier 112. Other examples of criterion may also be used.

Different actions may be taken when the criterion is met. In one example, the controller 102 is configured and arranged to deactivate the motor substantially immediately upon the setting of the alarm condition. In another example, the controller 102 is configured and arranged to deactivate the motor after expiration of a predetermined time period upon the setting of the alarm condition. Other actions may also be taken upon determination of spring failure.

In the example of FIG. 1, the controller 102 is further configured and arranged to activate the annunciator 108 upon setting the alarm condition. The annunciator 108 may take on a number of forms. For example, the annunciator 108 may be a light emitting diode (LED), a work light on the operator, a display, and/or an audio speaker. Other examples of annunciators and combinations of annunciators may also be used.

The alarm condition may also be used to indicate various types of spring failure. By one approach, the alarm condition can indicate that the spring has broken. In another example, the alarm condition can indicate that the spring is no longer suitably counterbalancing the movable barrier (which may not necessarily mean that the spring has broken). Other types of spring failure may also be indicated by the alarm condition.

Figure 2:
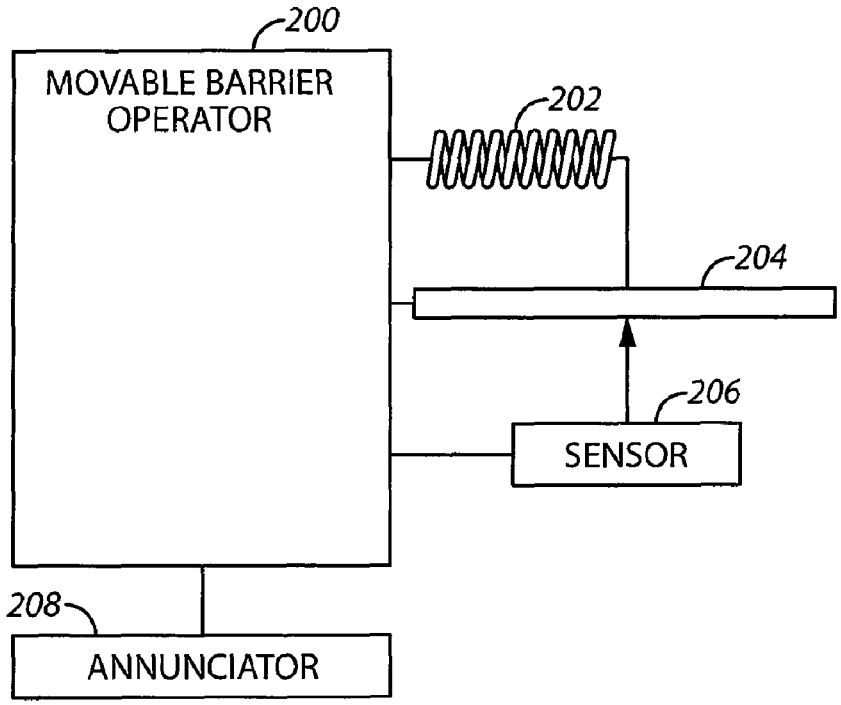
FIG. 2 comprises a block diagram of another example of a spring failure detection system according to various embodiments of the present invention.

Referring now to FIG. 2, an example of a movable barrier operator system that determines spring failure is described. The movable barrier operator system includes a spring 202, a movable barrier operator 200, a sensor 206, a movable barrier 204, and an annunciator 208.

The spring 202 may be any type of spring or springs that are used to counterbalance the weight of or other forces associated with the barrier 206. The movable barrier operator 200 may be any type of barrier operator that is used to move a barrier. For example, it may be a garage door operator, a swinging gate operator, a sliding gate operator. Other examples of barrier operators are possible. The barrier 204 may be any type of barrier. For example, it may be a garage door, a swinging gate, a sliding gate, or shutters. Other examples of barriers are possible.

The sensor 206 may be any type of device that is capable of determining movement characteristics of the barrier 204. The sensor 206 may monitor the barrier 204 (e.g., the position of the barrier) or it may monitor the barrier operator 200 to determine barrier movement (e.g., it may monitor the speed of a motor that is driving the barrier 204 in order to determine a characteristic of movement). Multiple sensors may also be used to determine multiple characteristics. Those skilled in the art will appreciate that this sensor 206 need not comprise a sensor that directly senses, for example, breakage of the spring. Instead, and as described herein for the sake of example, this sensor 206 can detect other operational indicia which, when properly interpreted, can reliably detect when spring failure occurs.

The movable barrier operator 200 is arranged and configured to move the movable barrier 204 from a first position to a second position along the track of the movable barrier 204 while substantially simultaneously monitoring at least one characteristic sensed by the sensor 206 and associated with moving the movable barrier 204 to provide a monitored result. The movable barrier operator 200 is further configured and arranged to compare the monitored result with a predetermined criterion, and when the monitored result does not meet the predetermined criterion, setting an alarm condition to indicate a failure of the spring 202. This predetermined criterion will vary, of course, with respect to the particular operational characteristic being monitored. When the monitored characteristic comprises, for example, a particular amount of time required for the movable barrier to move from the first position to the second position, this predetermined criterion can comprise a maximum (or minimum) amount of time within which this movement is allowed to occur.

The positions from which the barrier 204 may be moved from or to which the barrier may be moved to may be a variety of different types of positions. For example, the positions may be the fully closed position, a fully open position, a partially open or closed position, or any intermediate position. Other examples of positions are possible.

The positions may also be spaced according to different dimensions with respect to each other. In one example, the second position is less than two feet from the fully closed position. The positions may be spaced at other dimensions as well.

The predetermined criterion may also take a number of forms. For example, the predetermined criterion may consist of the movable barrier 204 achieving a predetermined speed upon reaching the second position. In another example, the predetermined criterion may relate to the movable barrier reaching a specific acceleration value when it reaches the second position.

Different actions can be taken based upon reaching the predetermined criterion. In one example, the movable barrier operator 200 is configured and arranged to be deactivated substantially immediately upon the setting of the alarm condition. In another example, the movable barrier operator 200 is configured and arranged to become deactivated after expiration of a predetermined time period upon the setting of the alarm condition. This might comprise, for example, halting movement of the movable barrier five seconds after setting the alarm condition. This can be done to allow egress in situations where the barrier is the only point of egress.

The annunciator 208 is further configured and arranged to activate in response to this setting of the alarm condition. The annunciator 208 may take on a number of forms. For example, the annunciator 208 may be a light emitting diode (LED), a work light on the operator, a display, and/or an audio speaker. Other examples of annunciators are possible. In addition, various combinations of annunciators may also be used.

Figure 3:
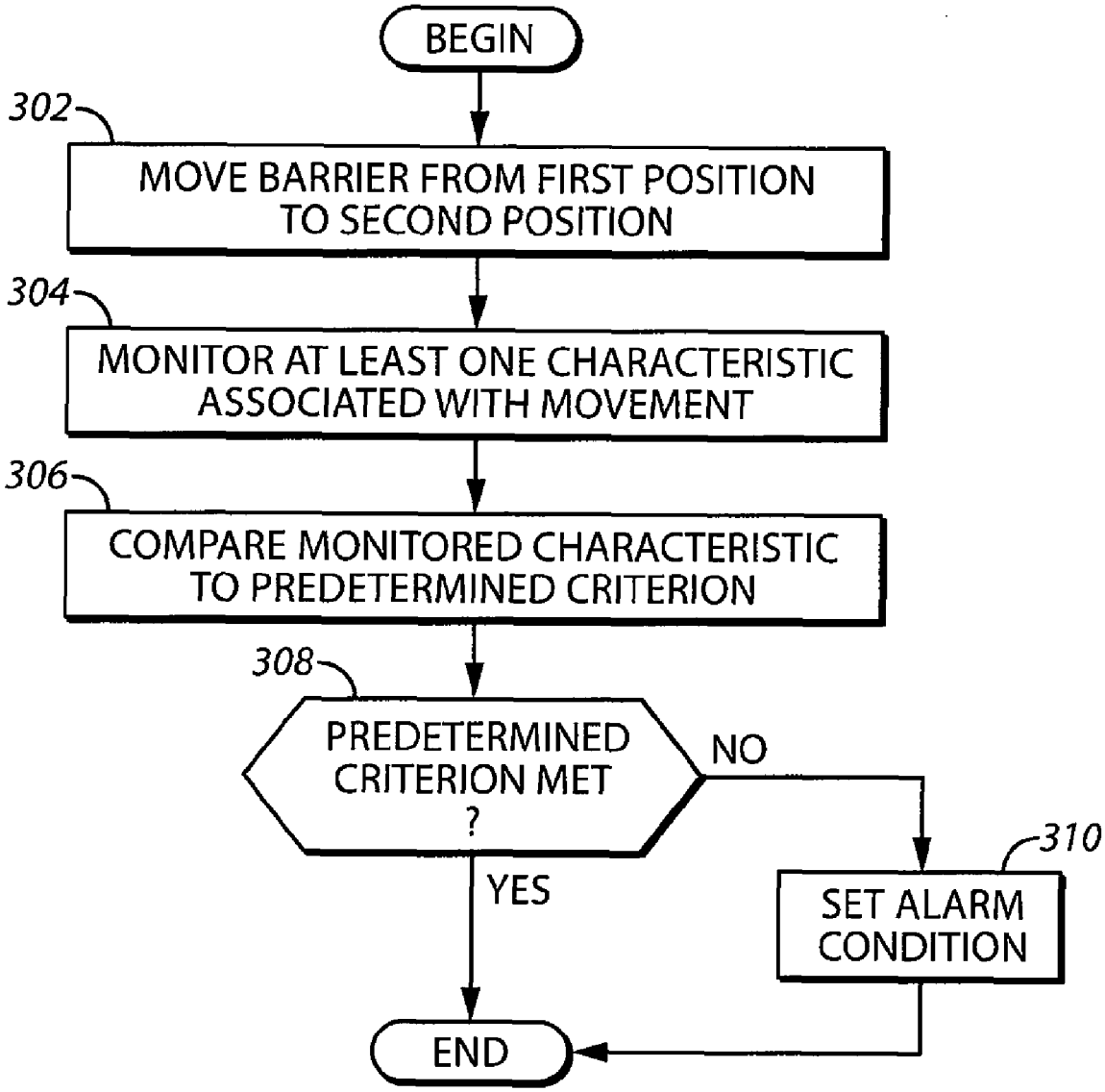
FIG. 3 comprises a flowchart of the operation of a spring failure detection system according to various embodiments of the present invention.

Referring now to FIG. 3, one example of an approach for operating a movable barrier operator system to detect spring failure is described. At step 302, the movable barrier is moved from a first position to a second position. The first and second positions may be any combination of open, closed, or intermediate positions. These positions also may be related according to different separation distances. Additionally, in one example, the first and second positions may be changed over time.

At step 304, during the movement of the barrier, one or more characteristics associated with the movement of the barrier are monitored. For example, the acceleration, speed, position, or some other barrier characteristic associated with the movement of the barrier are monitored. In other examples, more than one characteristic can be measured and used. For example, two different types of characteristics can be monitored (e.g., speed and position) and measured.

At step 306, the one or more monitored characteristics are compared to one or more predetermined criteria. For example, the predetermined criterion may be a position, acceleration, or speed of the barrier. Other examples of predetermined criterion are possible.

At step 308, it is determined if the predetermined criterion is met. In one example, an exact match is required. For example, the barrier may be required to reach at least a certain predetermined speed when it reaches the second position. In other examples, a match exists if it is determined that the measured characteristic falls within a range of allowable values. For example, a match may be determined if the speed of the barrier falls within a range of values at a predetermined position.

Thus, approaches are provided that automatically determine whether a spring has failed and prevents the barrier operator from moving the barrier when such a situation is determined. The approaches described herein are easy to use and prevent the failure of a spring from presenting a hazard to users and/or damage to the barrier. These teachings will readily accommodate relatively inexpensive mechanisms that indirectly contribute to the detection of spring failure. Those skilled in the art will further recognize and appreciate that these teachings are highly scalable and can be successfully applied in conjunction with a wide variety of springs, operators, movable barriers, and so forth.

Those skilled in the art will recognize that a wide variety of modifications, alterations, and combinations can be made with respect to the above described embodiments without departing from the spirit and scope of the invention, and that such modifications, alterations, and combinations are to be viewed as being within the scope of the invention.

What is claimed is:

1. A method for determining a failure of a spring in a movable barrier operator system comprising a motor, a spring, and a movable barrier, the motor configured to move the movable barrier between an open position and a closed position relative to an enclosure, the spring coupled to the movable barrier and configured to at least in part counterbalance weight of the movable barrier during movement of the movable barrier by the motor, the method comprising:

moving the movable barrier that is at least partially counterbalanced by the spring with the motor from a first position to a second position;

during movement of the movable barrier to the open position or during movement of the movable barrier to the closed position by the motor, monitoring at least one characteristic of the movement of the movable barrier;

comparing the at least one monitored characteristic measured during only one of:

moving the movable barrier from the closed position to the open position, or moving the movable barrier from the open position to the closed position, to a criterion related to the movement of the movable barrier not based on a movement of the movable barrier immediately preceding the movement or cycle during which the characteristic is measured;

wherein variance from the criterion is indicative of spring failure; and setting an alarm condition to indicate a failure of the spring when the at least one monitored characteristic does not meet the criterion.

2. The method of claim 1 wherein moving the movable barrier from a first position to a second position comprises moving the movable barrier from the closed position to the second position.

3. The method of claim 2 wherein the second position is less than approximately two feet from the first position.

4. The method of claim 1 wherein the criterion is the movable barrier achieving a predetermined position.

5. The method of claim 1 further comprising substantially immediately halting moving of the movable barrier upon setting the alarm condition.

6. The method of claim 1 further comprising halting moving of the movable barrier after expiration of a predetermined time period upon setting the alarm condition.

7. The method of claim 1 wherein the at least one characteristic is associated with acceleration of the moveable barrier.

8. The method of claim 1 further comprising activating an annunciator upon setting the alarm condition.

9. The method of claim 1 wherein the first position and the second position are selected from a group consisting of: the open position, an intermediate position, and the closed position.

10. A movable barrier operator comprising:

a motor coupled to a movable barrier, the motor configured to move the movable barrier between an open position and a closed position relative to an enclosure, the movable barrier having a weight counterbalanced at least in part using a spring during movement of the movable barrier by the motor;

a sensor;

a controller coupled to the motor and the sensor, the controller arranged and configured to actuate the motor to move the movable barrier from a first position to a second position while substantially simultaneously monitoring at least one characteristic sensed by the sensor, and the at least one characteristic being associated with moving the movable barrier to provide a monitoring result measured during only one of:

moving the movable barrier from the closed position to the open position, and moving the movable barrier from the open position to the closed position, the controller further configured and arranged to compare the monitoring result to a criterion related to the movement of the movable barrier not based on a movement of the movable barrier immediately preceding the movement or cycle during which the characteristic is sensed, wherein variance from the criterion is indicative of spring failure, and when the monitoring result does not meet the criterion, setting an alarm condition to indicate a failure of the spring.

11. The movable barrier operator of claim 10 wherein the controller is configured and arranged to actuate the motor to move the movable barrier from a closed position to at least the second position.

12. The movable barrier operator of claim 11 wherein the second position is less than approximately two feet from the first position.

13. The movable barrier operator of claim 10 wherein the criterion is the movable barrier achieving a predetermined position and wherein the movable barrier achieves a predetermined speed upon reaching the second position.

14. The movable barrier operator of claim 10 wherein the controller is configured and arranged to deactivate the motor substantially immediately upon the setting of the alarm condition.

15. The movable barrier operator of claim 10 wherein the controller is configured and arranged to deactivate the motor after expiration of a predetermined time period upon the setting of the alarm condition.

16. The movable barrier operator of claim 10 wherein the at least one characteristic is associated with acceleration of the moveable barrier.

17. The movable barrier operator of claim 10 wherein the controller is further configured and arranged to activate an annunciator upon setting the alarm condition.

18. The movable barrier operator of claim 10 wherein the first position and the second position are selected from a group consisting of: the open position, an intermediate position, and the closed position.

19. The movable barrier operator of claim 10 wherein setting an alarm condition to indicate a failure of the spring comprises setting an alarm condition to indicate that the spring has broken.

20. The movable barrier operator of claim 10 wherein setting an alarm condition to indicate a failure of the spring comprises setting an alarm condition to indicate that the spring is no longer suitably counterbalancing the movable barrier.

21. A movable barrier operator system comprising:

a spring;

a movable barrier with a weight at least partially counterbalanced by the spring;

a motor configured to move the movable barrier between an open position and a closed position relative to an enclosure;

a sensor; and a movable barrier operator coupled to the motor, movable barrier and the sensor, the movable barrier operator arranged and configured to actuate the motor to move the movable barrier from a first position to a second position while substantially simultaneously monitoring at least one characteristic sensed by the sensor, and the at least one characteristic being associated with moving the movable barrier to provide a monitored result measured during only one of:

moving the movable barrier from the closed position to the open position, and moving the movable barrier from the open position to the closed position, the movable barrier operator further configured and arranged to compare the monitored result with a criterion related to the movement of the barrier not based on a movement of the movable barrier immediately preceding the movement or cycle during which the characteristic is sensed, wherein variance from the criterion is indicative of spring failure, and when the monitored result does not meet the criterion, setting an alarm condition to indicate a failure of the spring.

22. The movable barrier operator system of claim 21 wherein the first position comprises the fully closed position.

23. The movable barrier operator system of claim 22 wherein the second position is less than two feet from the fully closed position.

24. The movable barrier operator system of claim 21 wherein the criterion comprises the movable barrier achieving a predetermined speed upon reaching the second position.

25. The movable barrier operator system of claim 21 wherein the movable barrier operator is configured and arranged to be deactivated substantially immediately upon the setting of the alarm condition.

26. The movable barrier operator system of claim 21 wherein the movable barrier operator is configured and arranged to become deactivated after expiration of a predetermined time period upon the setting of the alarm condition.

27. The movable barrier operator system of claim 21 wherein the at least one characteristic is associated with acceleration of the moveable barrier.

28. The movable barrier operator system of claim 21 further comprising an annunciator and wherein the movable barrier operator is further configured and arranged to activate the annunciator upon setting the alarm condition.

29. The movable barrier operator of claim 21 wherein the annunciator is selected from a group consisting of: a light emitting diode (LED), a display, and an audio speaker.

30. The movable barrier operator of claim 21 wherein the first position and the second position are selected from a group consisting of: the open position, an intermediate position, and the closed position.

31. The method of claim 1 wherein the movable barrier is a garage door, swinging door, swinging gate, sliding gate, or shutter.

32. The method of claim 1 wherein the criterion is the speed of the movable barrier.

33. A method for determining a failure of a spring in a movable barrier operator system, the method comprising:

moving a barrier by a motor and between an open and closed position relative to an enclosure and while a spring at least partially counterbalances the weight of the barrier;

during movement of the barrier to the open position or during movement of the barrier to the closed position by the motor, monitoring a characteristic of the movement of the movable barrier;

comparing the at least one monitored characteristic measured during only one of:

moving the barrier from the closed position to the open position, and moving the barrier from the open position to the closed position to a criterion that includes at least one of the speed, acceleration, or position of the barrier not based on a movement of the movable barrier immediately preceding the movement or cycle during which the characteristic is measured;

wherein variance from the criterion is indicative of spring failure; and setting a condition to indicate a failure of the spring when the at least one monitored characteristic does not meet the criterion.

34. A movable barrier operator apparatus comprising:

a spring;

a barrier with a weight at least partially counterbalanced by the spring;

a motor configured to move the barrier between an open and closed position relative to an enclosure;

a sensor; and a movable barrier operator configured to actuate the motor to move the barrier, and coupled to the sensor to monitor at least one characteristic sensed by the sensor during movement of the barrier to the open position or during movement of the barrier to the closed position, and the at least one characteristic being associated with moving the barrier to provide a monitored result measured during only one of:

moving the movable barrier from the closed position to the open position, and moving the movable barrier from the open position to the closed position, the movable barrier operator further configured and arranged to compare the monitored result with a criterion that includes at least one of the speed, acceleration, or position of the barrier not based on a movement of the movable barrier immediately preceding the movement or cycle during which the characteristic is sensed, wherein variance from the criterion is indicative of spring failure, and in response to the monitored result not meeting the criterion, setting a condition to indicate a failure of the spring.

35. A movable barrier operator apparatus comprising: a movable barrier;

a spring counterbalancing at least some of the weight of the movable barrier;

a motor for moving the movable barrier in one direction to an open position and in another direction to a closed position relative to an enclosure;

at least one sensor for monitoring a characteristic of the movable barrier; and a movable barrier operator configured to:

actuate the motor, provide a single direction monitoring result based on monitoring of the characteristic and not based on a movement of the movable barrier immediately preceding the movement or cycle during which the characteristic is monitored, wherein variance from the criterion is indicative of spring failure, while the motor moves the movable barrier in only one of the directions, and set a condition to indicate a spring failure if the single direction monitoring result does not meet a criterion.

* * * * *